US009644919B1

(12) United States Patent
Liu

(10) Patent No.: US 9,644,919 B1
(45) Date of Patent: May 9, 2017

(54) SECONDARY SAFETY DEVICE FOR CROSSBOWS

(71) Applicant: Chi-Chang Liu, Taichung (TW)

(72) Inventor: Chi-Chang Liu, Taichung (TW)

(73) Assignee: Poe Lang Enterprise Co., Ltd., Taichung (TW)

( * ) Notice: Subject to any disclaimer, the term of this patent is extended or adjusted under 35 U.S.C. 154(b) by 0 days.

(21) Appl. No.: 15/203,778

(22) Filed: Jul. 6, 2016

(30) Foreign Application Priority Data

May 20, 2016 (TW) ..... 105115795 A

(51) Int. Cl.
*F41B 5/12* (2006.01)
*F41B 5/14* (2006.01)

(52) U.S. Cl.
CPC ..... *F41B 5/1403* (2013.01); *F41B 5/12* (2013.01)

(58) Field of Classification Search
CPC ..... F41B 5/12; F41B 5/123
See application file for complete search history.

(56) References Cited

U.S. PATENT DOCUMENTS 4,192,281 A * 3/1980 King ..... F41B 5/1469 124/25
5,215,069 A * 6/1993 Liu ..... F41B 5/12 124/25
5,649,520 A * 7/1997 Bednar ..... F41B 5/12 124/25
6,736,123 B1 * 5/2004 Summers ..... F41A 17/46 124/25

* cited by examiner

*Primary Examiner* — John Ricci
(74) *Attorney, Agent, or Firm* — Rosenberg, Klein & Lee

(57) ABSTRACT

A crossbow includes a body and an activator. The body has a shooting device, a first safety device and a string connected thereto. The shooting device has a trigger. The activator is located at the rear end of the body and has an extension. A second safety device is located between the extension and the body, and includes a rod and contact member. When the activator is operated, the activator is removed from the rod which pivots the contact member, and the contact member contacts the first safety device to restrict the trigger from being pulled. When the activator is not operated and positioned at the body, the rod is pushed by the activator and pivots the contact member, and the first safety device is released so that the trigger can be pulled.

8 Claims, 10 Drawing Sheets

SECONDARY SAFETY DEVICE FOR CROSSBOWS

BACKGROUND OF THE INVENTION

1. Fields of the Invention

The present invention relates to a crossbow, and more particularly, to a secondary safety device for a crossbow.

2. Descriptions of Related Art

The conventional safety device of a crossbow is located behind the shooting device, when the user pulls the string, he or she has to pull the string and secured at the shooting device. If the user unintentionally touches the trigger or pushes the safety device to release the safety device, the arrow can shoot toward any direction to hurt people. The user may also be hurt by the string bouncing back.

The present invention intends to provide a secondary safety device which effectively eliminates the shortcomings mentioned above.

SUMMARY OF THE INVENTION

The present invention relates to a crossbow and comprises a body and an activator, wherein the body has a shooting device, a first safety device and a string connected thereto, and the shooting device has a trigger. The string is located at the front end of the body, and the activator is located at the rear end of the body and has an extension which extends toward the body. The extension pulls the string and hooks the string to the shooting device. The first safety device presses one end of the trigger to restrict the trigger from being pulled.

A second safety device is located between the body and the activator. The second safety device presses the first safety device and restricts the first safety device and the trigger from being activated when the activator is operated. The second safety device has a rod and a contact member, wherein the rod is pivotably connected to the first end of the contact member, and the second end of the contact member is pressed by the activator. When the activator is operated, the activator is removed from the rod, and the rod pivots the contact member. The contact member contacts the first safety device to restrict the trigger from being pulled. When the activator is not operated and positioned at the body, the rod is pushed by the activator and pivots the contact member, and the first safety device is not restricted.

When the activator is operated, the activator is removed from the rod, and the rod pivots the contact member and the contact member contacts the first safety device to restrict the trigger from being pulled, the extension pulls the string and hooks the string at the shooting device. The activator is then pivoted and positioned at the body, so that the rod is pushed by the activator and pivots the contact member so that the first safety device is not restricted. An arrow is installed to the body. When the first safety device is applied by a force, the trigger is not restricted by the first safety device. When the trigger is pulled, the shooting device releases the string which shoots the arrow away.

Preferably, the body has a room defined therein. The shooting device includes a link, a restriction member and a hook member. The shooting device is located in the room. The trigger and the hook member are partially exposed from the room. The link has the first end thereof connected to the trigger, and the second end of the link is connected to the first end of the restriction member. The second end of the restriction member is connected to the hook member.

Preferably, the restriction member has a first hook on the second end thereof, and the hook member has a second hook which hooks the first hook.

Preferably, the rod has a head and a shank is connected to the head. The shank has a portion extending into the room and has a pivot. The contact member has a slot defined in the first end thereof. A press end is formed on the second end of the contact member. The pivot is located in the slot. A resilient member is mounted to the shank of the rod, and two ends of the resilient member are biased between the body and the head of the rod. The activator has a press portion. When the activator is operated, the press portion is removed from the head of the rod. The resilient member biases the head of the rod and pushes the shank of the rod toward the activator. The pivot of the shank moves in the slot and pivots the contact member so that the press end of the contact member contacts the first safety device and restricts the first safety device and the trigger which is prevented from being pulled. When the activator is pivoted back to the body, the press portion contacts the head of the rod and the shank moves toward the room. The pivot of the shank moves in the slot to pivot the contact member. The press end of the contact member is removed from first safety device.

Preferably, the first safety device has an activation member on the first end thereof, and a restriction portion is formed on the second end thereof. The body has a connection member which is located above the room. A resilient plate has the first end thereof connected to the connection member, and the second end of the resilient plate faces the activation member of the first safety device and has a restriction portion which restricts operation of the first safety device. When the extension pulls the string, the resilient plate is pushed upward by the string so that the restriction portion is removed from the activation member of the first safety device, so that the activation member of the first safety device is applied by a force to operate the first safety device and the restriction portion is released from the trigger.

Preferably, the activator has a pivotal member on the top thereof. When the pivotal member hooks the body to position the activator to the body, the pivotal member is separated from the body, and the activator can be operated.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
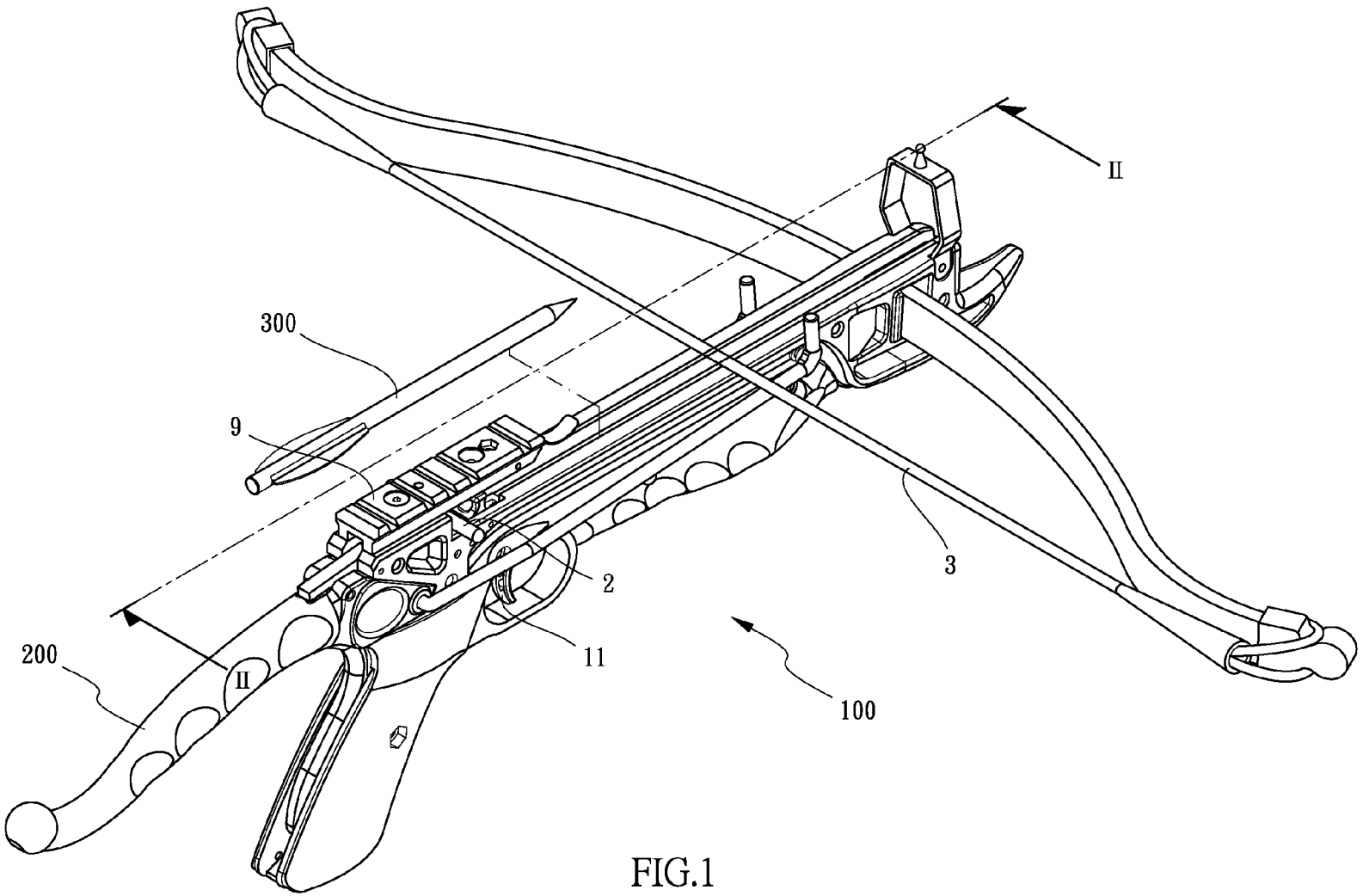
FIG. 1 is a perspective view to show the crossbow of the present invention.
Figure 2:
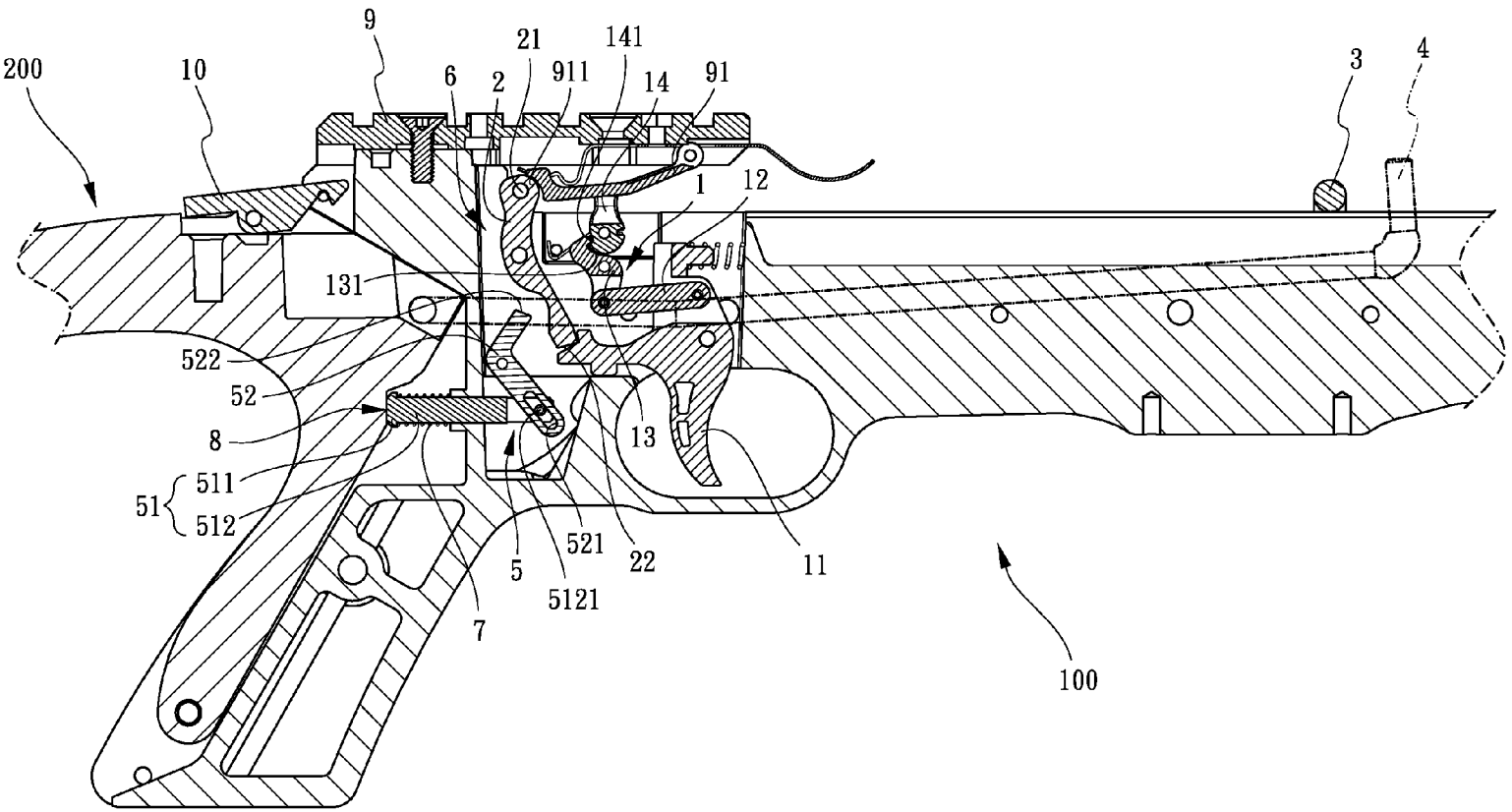
FIG. 2 is a cross sectional view, taken along line II-Ii in FIG. 1.
Figure 3:
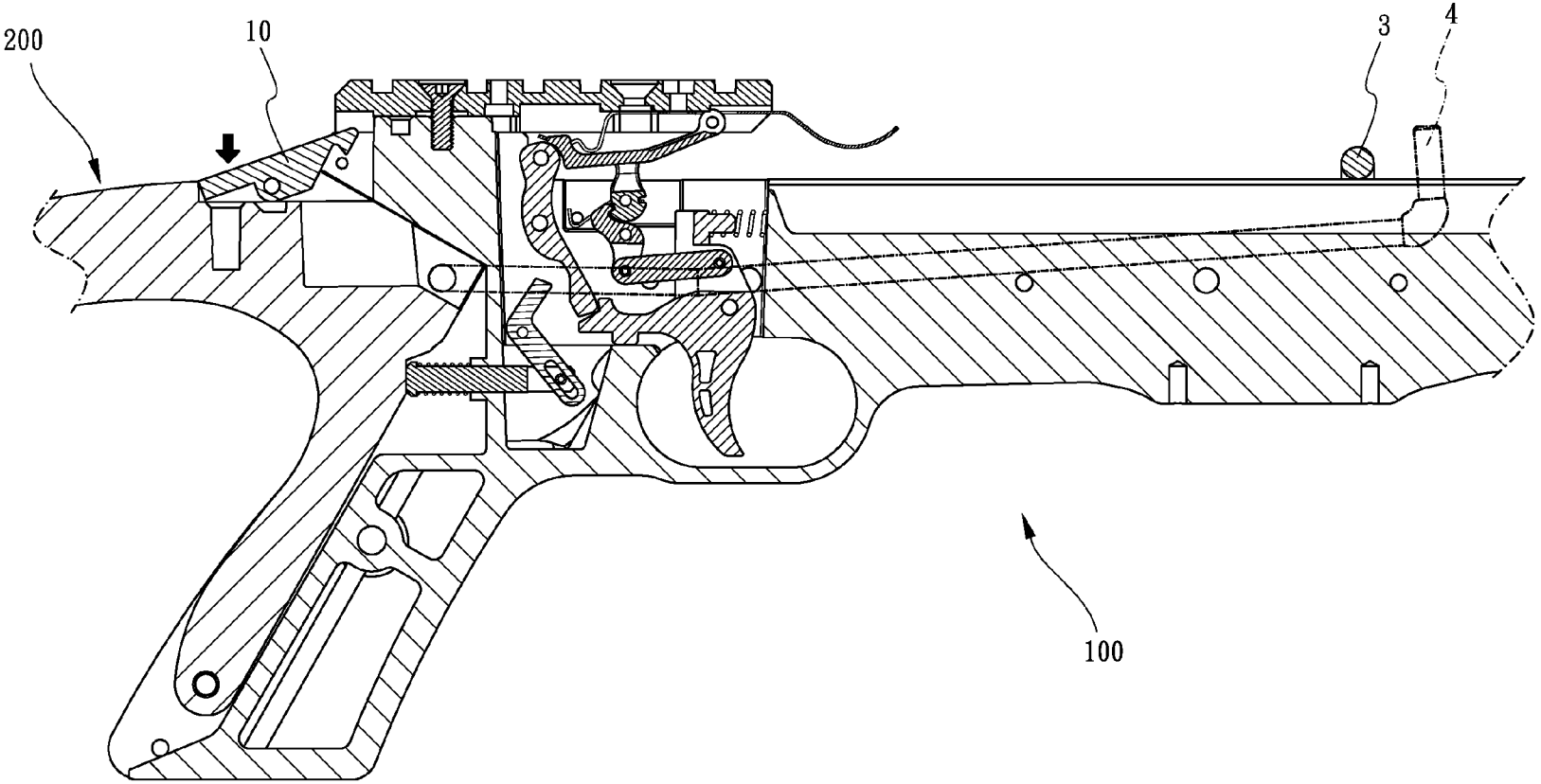
FIG. 3 is a cross sectional view of the crossbow of the present invention, wherein the pivotal member is pivoted so that the activator is able to be operated.

Referring to FIGS. 1 to 3, the crossbow of the present invention comprises a body 100 and an activator 200, wherein the body 100 has a shooting device 1, a first safety device 2 and a string 3 connected thereto. The shooting device 1 has a trigger 11. The string 3 is located at the front end of the body 100, and the activator 200 is located at the rear end of the body 100 and has an extension 4 which extends toward the body 100. The extension 4 pulls the string 3 and hooks the string 3 to the shooting device 1. The first safety device 2 presses one end of the trigger 11 to restrict the trigger 11 from being pulled.

A second safety device 5 is located between the body 100 and the activator 200. The second safety device 5 presses the first safety device 2 and restricts the first safety device 2 and the trigger 11 from being activated when the activator 200 is operated. The second safety device 5 has a rod 51 and a contact member 52, wherein the rod 51 is pivotably connected to the first end of the contact member 52, and the second end of the contact member 52 is pressed by the activator 200. When the activator 200 is operated, the activator 200 is removed from the rod 51, and the rod 51 pivots the contact member 52. The contact member 52 contacts the first safety device 3 to restrict the trigger 11 from being pulled. When the activator 200 is not operated and positioned at the body 100, the rod 51 is pushed by the activator 200 and pivots the contact member 52, and the first safety device 2 is not restricted.

When the activator 200 is operated, the activator 200 is removed from the rod 51, and the rod 51 pivots the contact member 52 and the contact member 52 contacts the first safety device 3 to restrict the trigger 11 from being pulled, the extension 4 pulls the string 3 and hooks the string 3 at the shooting device 1. The activator 200 is then pivoted and positioned at the body 100, so that the rod 51 is pushed by the activator 200 and pivots the contact member 52 so that the first safety device 2 is not restricted. An arrow 300 is installed to the body 100. When the first safety device 2 is applied by a force, the trigger 11 is not restricted by the first safety device 2. When the trigger 11 is pulled, the shooting device 1 releases the string 3 which shoots the arrow 300 away.

Preferably, the body 100 has a room 6 defined therein. The shooting device 1 includes a link 12, a restriction member 13 and a hook member 14. The shooting device 1 is located in the room 6. The trigger 11 and the hook member 14 are partially exposed from the room 6. The link 12 has the first end thereof connected to the trigger 11, and the second end of the link 12 is connected to the first end of the restriction member 13. The second end of the restriction member 13 is connected to the hook member 14 as shown in FIG. 2.

The restriction member 13 has a first hook 131 on the second end thereof, and the hook member 14 has a second hook 141 which hooks the first hook 131.

The rod 51 has a head 511 and a shank 512 is connected to the head 511. The shank 512 has a portion extending into the room 6 and has a pivot 5121. The contact member 52 has a slot 521 defined in the first end thereof. A press end 522 is formed on the second end of the contact member 52. The pivot 5121 is located in the slot 521. A resilient member 7 is mounted to the shank 512 of the rod 51, and two ends of the resilient member 7 are biased between the body 100 and the head 511 of the rod 51. The activator 200 has a press portion 8. When the activator 200 is operated, the press portion 8 is removed from the head 511 of the rod 51. The resilient member 7 biases the head 511 of the rod 51 and pushes the shank 512 of the rod 51 toward the activator 200. The pivot 5121 of the shank 512 moves in the slot 521 and pivots the contact member 52 so that the press end 522 of the contact member 52 contacts the first safety device 1 and restricts the first safety device 2 and the trigger 11 which is prevented from being pulled. Therefore, the string 3 does not bounce back by the shooting device 1. When the activator 200 is pivoted back and is positioned at the body 100, the press portion 8 contacts the head 511 of the rod 51 and the shank 512 moves toward the room 6. The pivot 5121 of the shank 512 moves in the slot 521 to pivot the contact member 52. The press end 522 of the contact member 52 is removed from first safety device 2 as shown in FIGS. 4 to 7.

As shown in FIG. 2, the first safety device 2 has an activation member 21 on the first end thereof, and a restriction portion 22 is formed on the second end thereof. The body 100 has a connection member 9 which is located above the room 6. A resilient plate 91 has the first end thereof connected to the connection member 9, and the second end of the resilient plate 91 faces the activation member 21 of the first safety device 2 and has a restriction portion 911 which restricts operation of the first safety device 2. When the extension 4 pulls the string 3, the resilient plate 91 is pushed upward by the string 3 so that the restriction portion 911 is removed from the activation member 21 of the first safety device 2, so that the activation member 21 of the first safety device 2 is applied by a force to operate the first safety device 2 and the restriction portion 22 is released relative to the trigger 11. The trigger is ready to be pulled.

As shown in FIGS. 2 and 3, the activator 200 has a pivotal member 10 on the top thereof. When the pivotal member 10 hooks the body 100 to position the activator 200 to the body 100, the pivotal member 10 is separated from the body 100, and the activator 200 can be operated.

Figure 4:
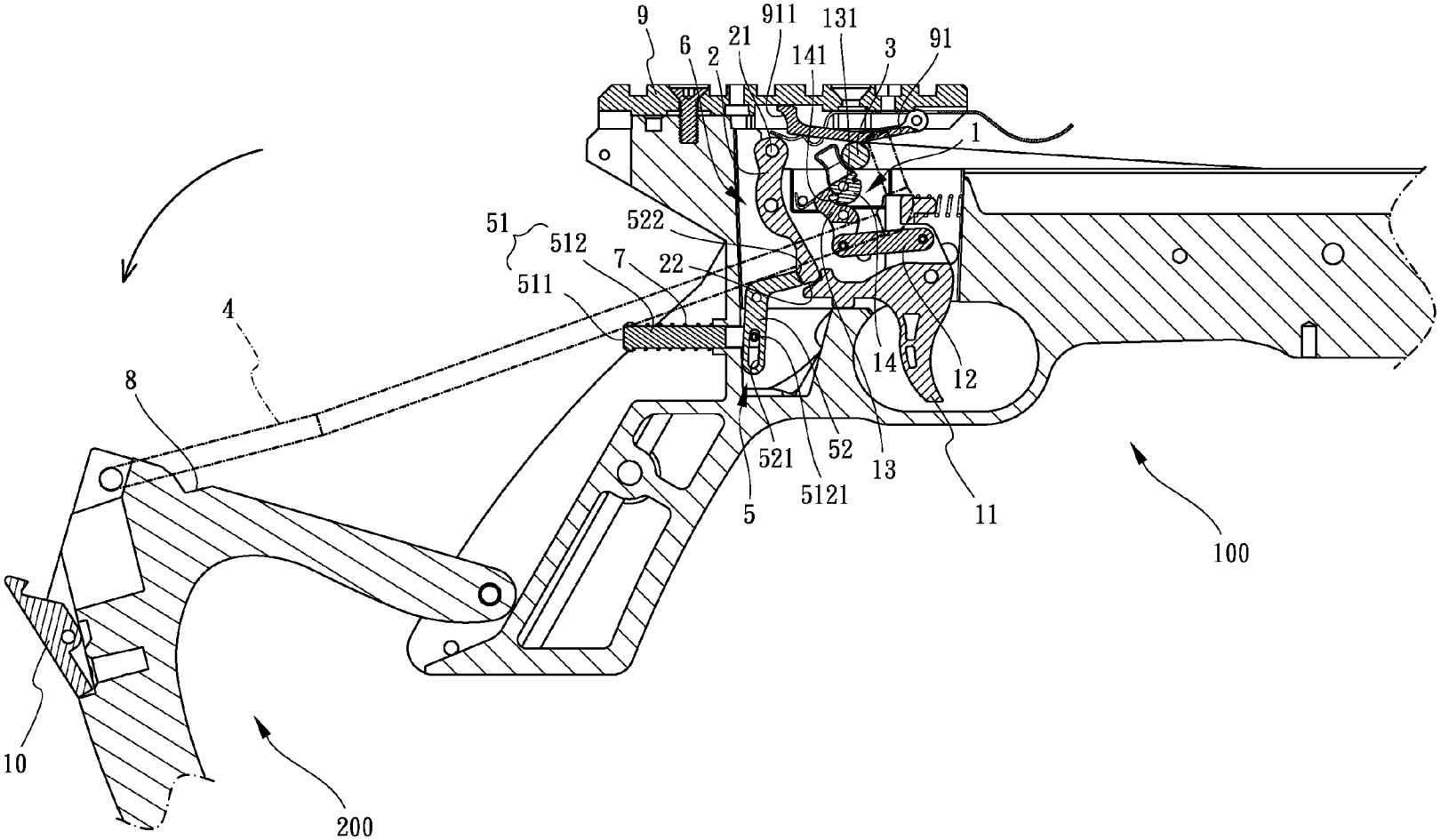
FIG. 4 is a cross sectional view of the crossbow of the present invention, wherein the activator is operated and the extension pulls the string, the resilient plate is pushed upward by the string to release the restriction to the first safety device, the second hook of the hook member is separated from the first hook of the restriction member, the rod of the second safety device is biased by the resilient member to pivot the contact member to contact the first safety device.
Figure 5:
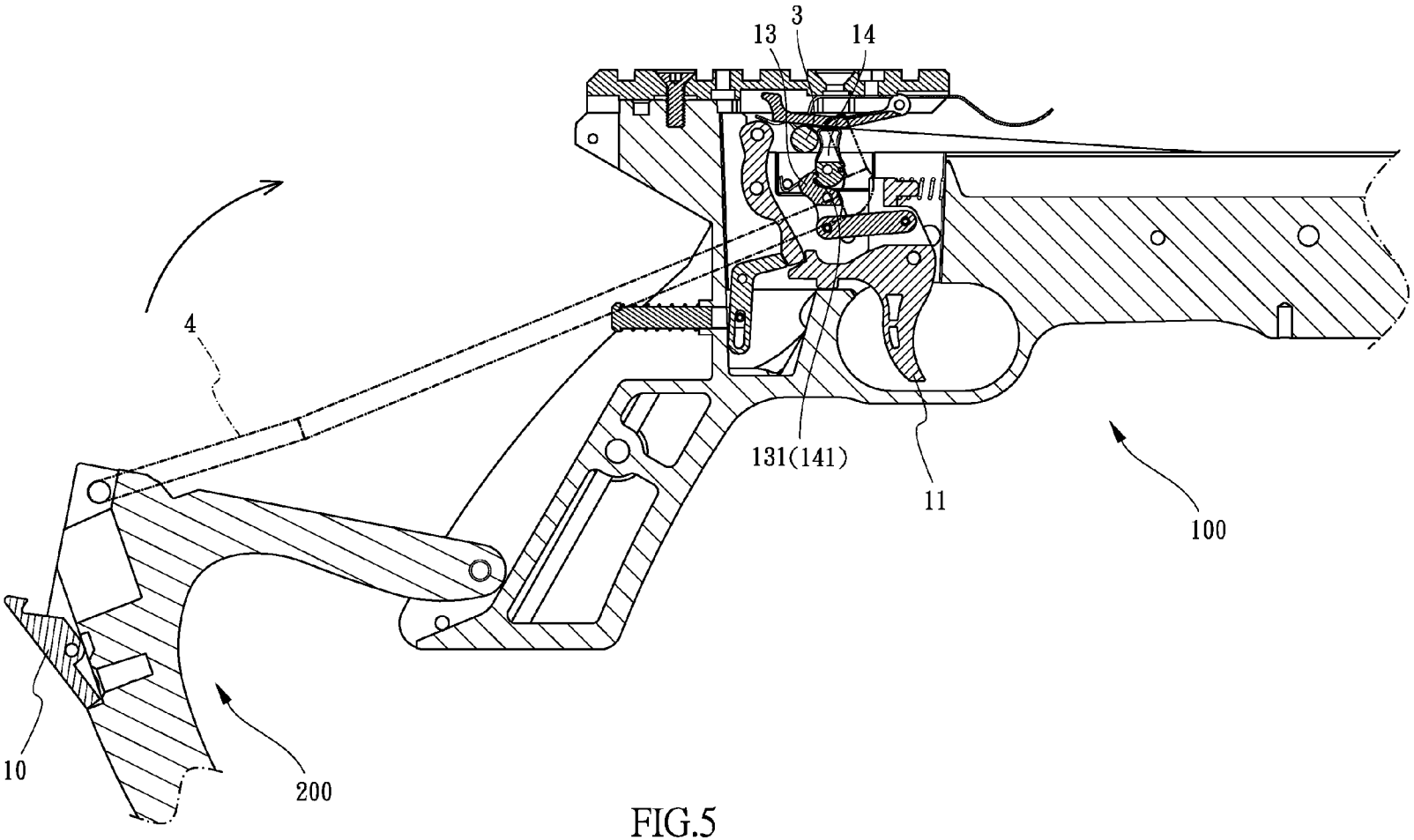
FIG. 5 is a cross sectional view of the crossbow of the present invention, wherein the activator is to be positioned at the body, and the hook member returns and hooks the string, and the first hook of the restriction member hooks the second hook of the hook member.

When in use, the pivotal member 10 is pivoted so that the activator 200 is able to be operated which means the activator 200 can be pivoted in a direction away from the pivotal member 10. When the activator 200 is operated and the extension 4 pulls the string 3 which is pulled toward the shooting device 1. The resilient plate 91 of the connection member 9 is pushed upward by the string 3, and the string 3 pivots the hook member 14 which is pivoted toward the activator 200 as shown in FIG. 4. After the string 3 passes over the hook member 14, the hook member 14 pivots back by the spring therein. The second hook 141 of the hook member 14 hooks the first hook 131 of the restriction member 13. The hook member 14 hooks the string 3 as shown in FIG. 5. The extension 4 contacts the first safety device 2 which is engaged with the trigger 11 so that the trigger 11 cannot be pulled. This is the first safety feature during the action of pulling the string 3. During the process that the activator 200 is pivoted back, the activator 200 releases the restriction to the rod 51 of the second safety device 5 so that the resilient member 7 on the shank 512 of the rod 51 biases the head 511 of the rod 51, and the shank 512 moves toward the activator 200. The pivot 5121 of the shank 512 moves in the slot 521 so that the press end 522 of the contact member 52 contacts and restricts the first safety device 2. The trigger 11 is restricted from being pulled so that the string 3 is not activated by the shooting device 1 as shown in FIGS. 4 and 5. This is the second safety feature during the process of pulling the string 3.

Figure 6:
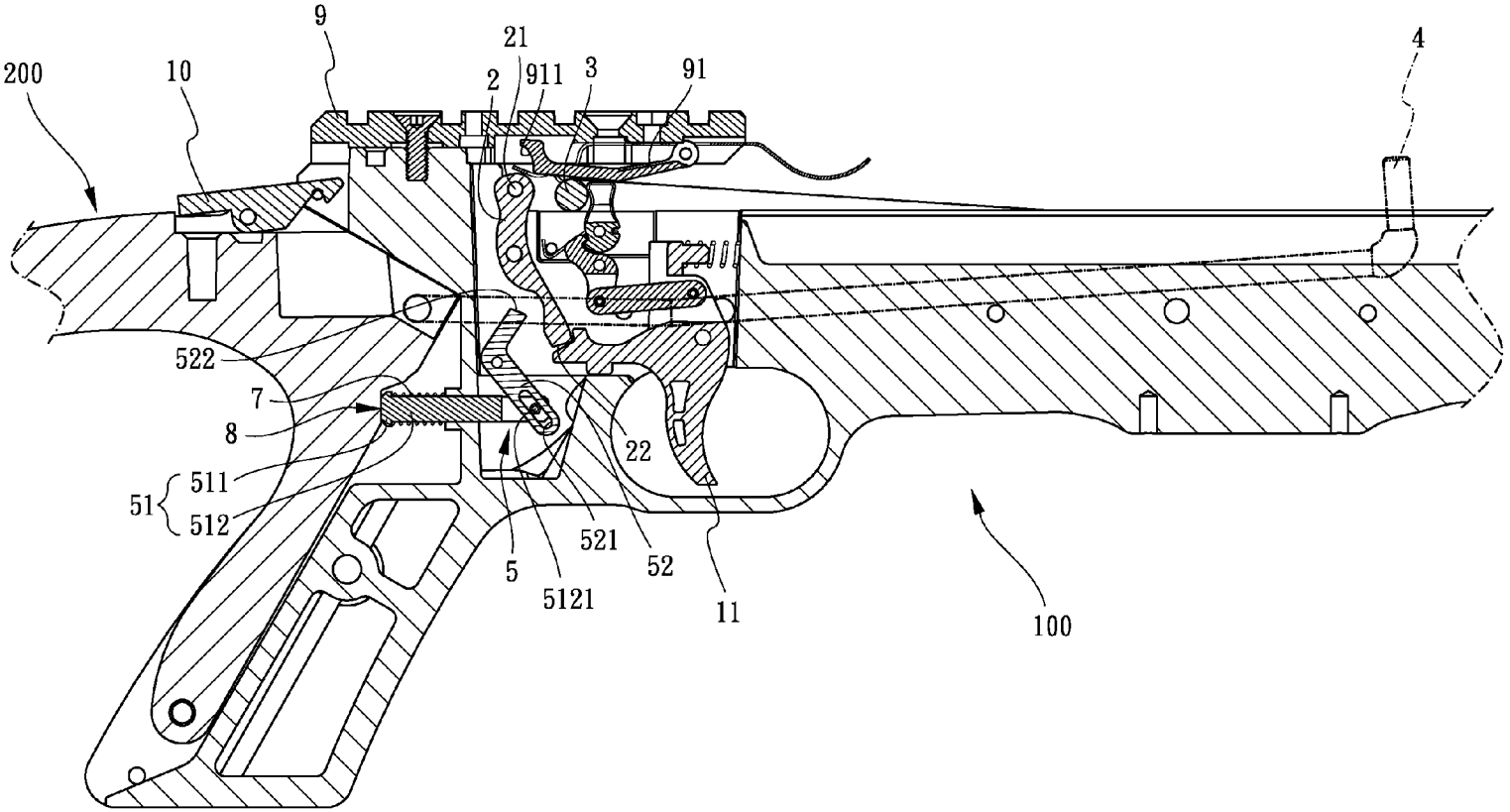
FIG. 6 is a cross sectional view of the crossbow of the present invention, wherein the activator is positioned at the body, and the press portion contacts the rod to pivot the contact member so as to release the restriction to the first safety device, the string is hooked to the hook member, the resilient plate is pivoted upward.

When the activator 200 is positioned at the body 100, the press portion 8 contacts the head 511 of the rod 51 to move the shank 512 toward the room 6. The pivot 5121 of the shank 512 moves in the slot 521 so that the press end 522 of the contact member 52 releases the restriction to the first safety device 2 as shown in FIG. 6.

Figure 7:
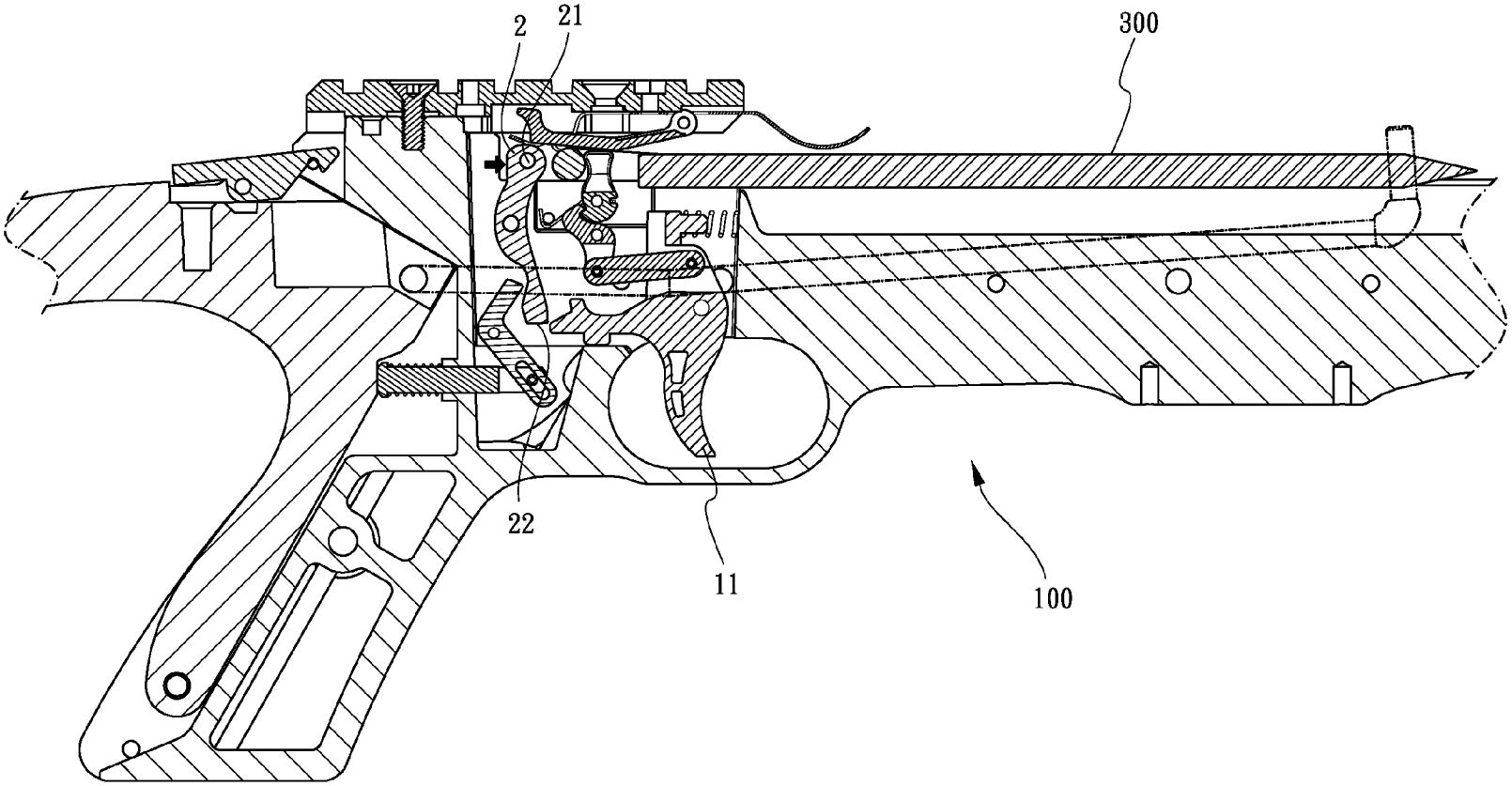
FIG. 7 is a cross sectional view of the crossbow of the present invention, wherein an arrow is installed to the body, the activation member of the first safety device is operated so that the restriction portion releases the restriction to the trigger.
Figure 8:
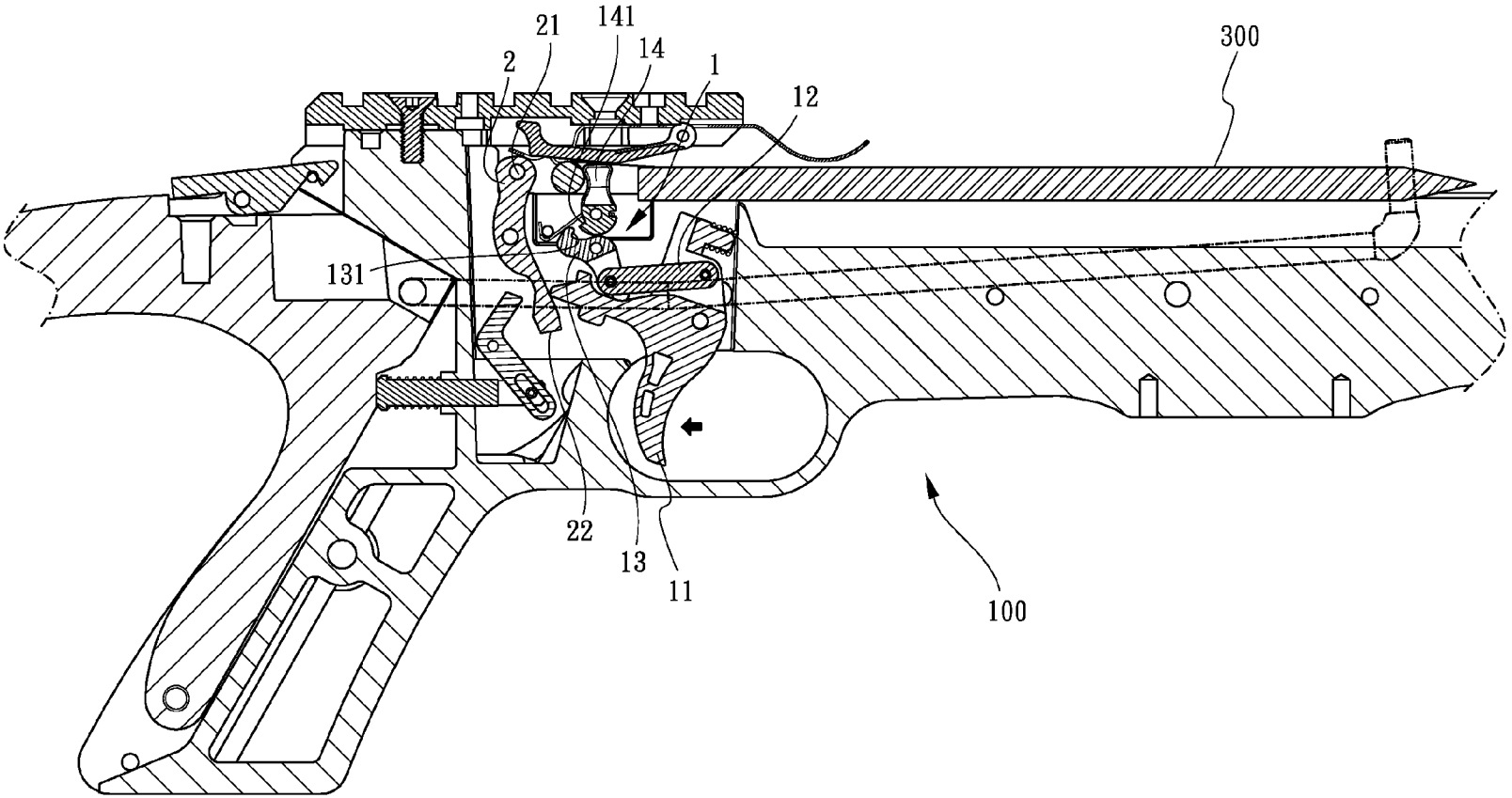
FIG. 8 is a cross sectional view of the crossbow of the present invention, wherein the trigger is pulled, the link pivots the restriction member so that the first hook is separated from the second hook of the hook member.
Figure 9:
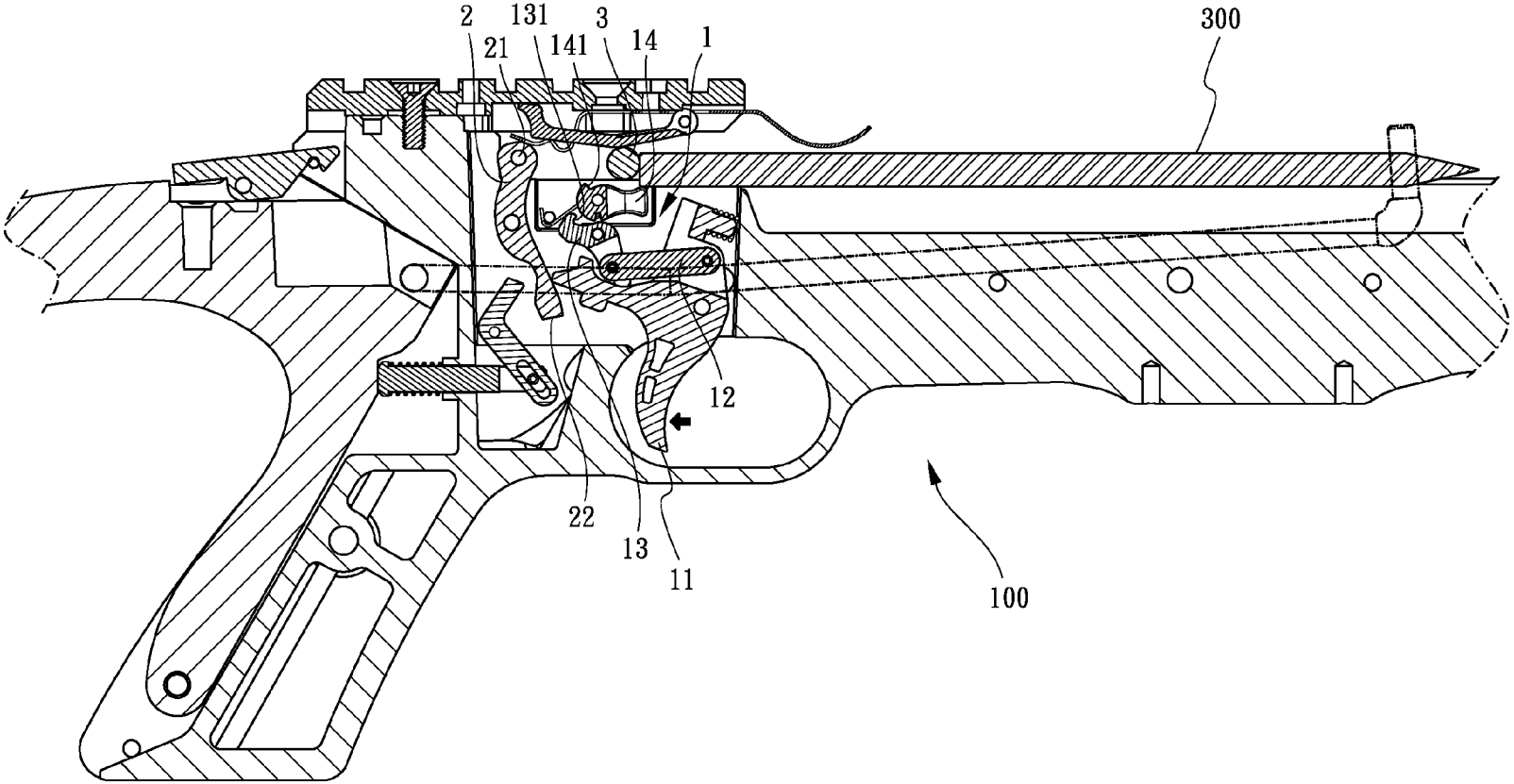
FIG. 9 is a cross sectional view of the crossbow of the present invention, wherein the trigger is pulled and the arrow is to be delivered by the resilient force of the string.
Figure 10:
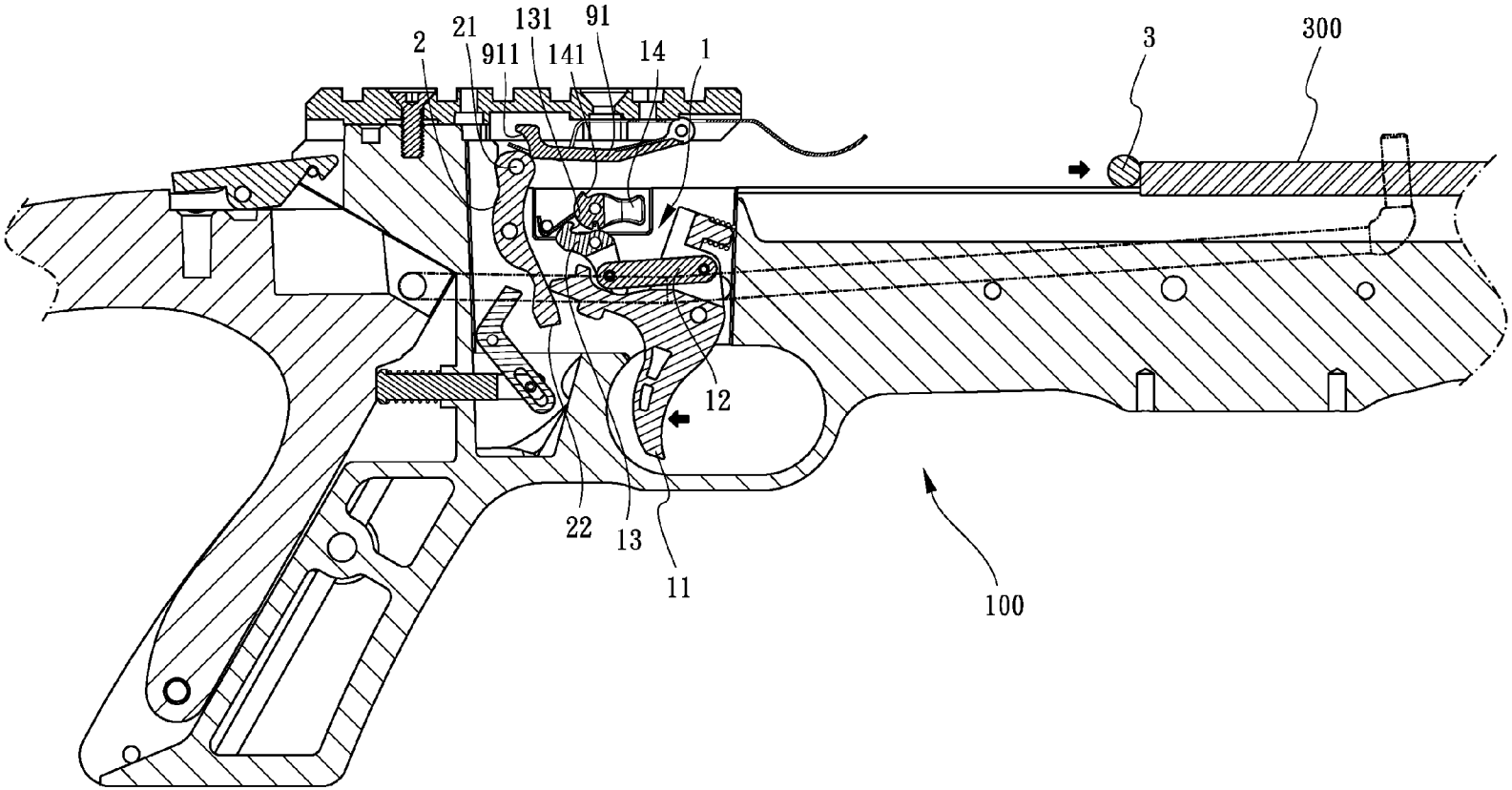
FIG. 10 shows that the arrow shoots by the resilient force of the string.

An arrow 300 is installed to the body 100, because the resilient plate 91 is pushed by the string 3, the restriction portion 911 releases the restriction to the activation member 21 of the first safety device 2. The user then pushes the activation member 21 toward the hook member 14, so that the restriction portion 22 releases the restriction to the trigger 11 as shown in FIG. 7. When the user pulls the trigger 11, the trigger 11 drives the link 12 which pivots the restriction member 13. The first hook 131 of the restriction member 13 is separated from the second hook 141 of the hook member 14, so that the string 3 bounces back to shoot the arrow 300 away from the body 100 as shown in FIGS. 8 to 10.

As shown in FIG. 2, the first safety device 2 is initially engaged with the trigger 11 and therefore restricts the trigger 11 from being pulling, and this is the first safety feature of the action of pulling the string 3. As shown in FIG. 3, when the user operates the crossbow, the user first presses the pivotal member 10 on the top of the activator 200 so that the activator 200 can be pivoted backward, and the string 3 is pulled by the extension 4 and toward the shooting device 1. The string 3 pushes the resilient plate 91 upward, and the string 3 pivots the hook member 14 which is pivoted toward the activator 200 as shown in FIG. 4. When the string 3 passes over the hook member 14, the hook member 14 returns to its initial position by the spring in the hook member 14. The second hook 141 of the hook member 14 is hooked with the first hook 131 of the restriction member 13, such that the hook member 14 hooks the string 3 as shown in FIG. 5. In the meanwhile, when the activator 200 is pivoted backward, the activator 200 releases the restriction to the rod 51 of the second safety device 5, so that the resilient member 7 on the shank 512 of the rod 51 biases the head 511 of the rod 51 and moves the shank 512 toward the activator 200. The pivot 5121 of the shank 512 moves in the slot 521 and moves the contact member 52. The press end 522 of the contact member 52 contacts the first safety device 2 and restricts the first safety device 2 from being operated. The trigger 11 is restricted as well to prevent the string 3 from being activated by the shooting device 1 as shown in FIGS. 4 and 5. This is the second safety feature of the present invention. When the user secures the activator 200 at the body 100, the press portion 8 presses the head 511 of the rod 51 and the shank 512 of the rod 51 moves toward the room 6. Therefore, the pivot 5121 of the shank 512 of the rod 51 moves in the slot 521 of the contact member 52 and activates the contact member 52. The press end 522 of the contact member 52 releases the restriction to the first safety device 2 as shown in FIG. 6. The arrow 300 is then put to the body 100, because the resilient plate 91 is pushed by the string 3, so that the reception portion 911 of the resilient plate 91 releases the restriction to the activation member 21 of the first safety device 2. Therefore, the first safety feature made by the first safety device 2 in the initial status can be released by the user to manually push the activation member 21 toward the hook member 14, such that the restriction portion 22 of the first safety device 2 is released the restriction to the trigger 11 as shown in FIG. 7. When the trigger 11 is pulled, the link 12 is activated by the trigger 11, and the restriction member 13 is activated by the link 12, so that the first hook 131 of the restriction member 13 is disengaged from the second hook 141 of the hook member 14. The string 3 bounces forward to shoot the arrow 300 toward the target as shown in FIGS. 8 to 10.

While we have shown and described the embodiment in accordance with the present invention, it should be clear to those skilled in the art that further embodiments may be made without departing from the scope of the present invention.

What is claimed is:

1. A crossbow comprising:

a body and an activator, the body having a shooting device, a first safety device and a string connected thereto, the shooting device having a trigger, the string located at a front end of the body, the activator located at a rear end of the body and having an extension which extends toward the body, the extension pulling the string and hooking the string to the shooting device, the first safety device pressing one end of the trigger to restrict the trigger from being pulled;

a second safety device located between the body and the activator, the second safety device pressing the first safety device and restricting the first safety device and the trigger from being activated when the activator being operated, the second safety device having a rod and a contact member, the rod pivotably connected to a first end of the contact member, a second end of the contact member being pressed by the activator, when the activator is operated, the activator is removed from the rod, and the rod pivots the contact member, the contact member contacts the first safety device to restrict the trigger from being pulled, when the activator is not operated and positioned at the body, the rod is pushed by the activator and pivots the contact member, the first safety device is not restricted, and wherein, when the activator is operated, the activator is removed from the rod, the rod pivots the contact member and the contact member contacts the first safety device to restrict the trigger from being pulled, the extension pulls the string and hooks the string at the shooting device, the activator is pivoted back and positioned at the body, so that the rod is pushed by the activator and pivots the contact member so that the first safety device is not restricted, an arrow is installed to the body, when the first safety device is applied by a force, the trigger is not restricted by the first safety device, when the trigger is pulled, the shooting device releases the string which shoots the arrow away.

2. The crossbow as claimed in claim 1, wherein the body has a room defined therein, the shooting device includes a link, a restriction member and a hook member, the shooting device is located in the room, the trigger and the hook member are partially exposed from the room, the link has a first end connected to the trigger, a second end of the link is connected to a first end of the restriction member, a second end of the restriction member is connected to the hook member.

3. The crossbow as claimed in claim 2, wherein the restriction member has a first hook on the second end thereof, and the hook member has a second hook which hooks the first hook.

4. The crossbow as claimed in claim 3, wherein the rod has a head and a shank is connected to the head, the shank has a portion extending into the room and has a pivot, the contact member has a slot defined in the first end thereof, a press end is formed on the second end of the contact member, the pivot is located in the slot, a resilient member is mounted to the shank of the rod, two ends of the resilient member are biased between the body and the head of the rod, the activator has a press portion, when the activator is operated, the press portion is removed from the head of the rod, the resilient member biases the head of the rod and pushes the shank of the rod toward the activator, the pivot of the shank moves in the slot and pivots the contact member so that the press end of the contact member contacts the first safety device and restricts the first safety device and the trigger which is prevented from being pulled, when the activator is pivoted back to the body, the press portion contacts the head of the rod and the shank moves toward the room, the pivot of the shank moves in the slot to pivot the contact member, the press end of the contact member is removed from first safety device.

5. The crossbow as claimed in claim 2, wherein the rod has a head and a shank is connected to the head, the shank has a portion extending into the room and has a pivot, the contact member has a slot defined in the first end thereof, a press end is formed on the second end of the contact member, the pivot is located in the slot, a resilient member is mounted to the shank of the rod, two ends of the resilient member are biased between the body and the head of the rod, the activator has a press portion, when the activator is operated, the press portion is removed from the head of the rod, the resilient member biases the head of the rod and pushes the shank of the rod toward the activator, the pivot of the shank moves in the slot and pivots the contact member so that the press end of the contact member contacts the first safety device and restricts the first safety device and the trigger which is prevented from being pulled, when the activator is pivoted back to the body, the press portion 8 contacts the head of the rod and the shank moves toward the room, the pivot of the shank moves in the slot to pivot the contact member, the press end of the contact member is removed from first safety device.

6. The crossbow as claimed in claim 2, wherein the first safety device has an activation member on a first end thereof, and a restriction portion on a second end thereof, the body has a connection member which is located above the room, a resilient plate has a first end connected to the connection member, a second end of the resilient plate faces the activation member of the first safety device and has a restriction portion which restricts operation of the first safety device, when the extension pulls the string, the resilient plate is pushed upward by the string so that the restriction portion is removed from the activation member of the first safety device, so that the activation member of the first safety device is applied by a force to operate the first safety device and the restriction portion is released relative to the trigger, the trigger is ready for being pulled.

7. The crossbow as claimed in claim 6, wherein the activator has a pivotal member on a top thereof, when the pivotal member hooks the body to position the activator to the body, the pivotal member is separated from the body, the activator can be operated.

8. The crossbow as claimed in claim 1, wherein the activator has a pivotal member on a top thereof, when the pivotal member hooks the body to position the activator to the body, the pivotal member is separated from the body, the activator can be operated.

* * * * *